US010102985B1

(12) United States Patent
Pelletier et al.

(10) Patent No.: US 10,102,985 B1
(45) Date of Patent: Oct. 16, 2018

(54) THIN PROFILE SEALED BUTTON ASSEMBLY

(71) Applicant: Apple Inc., Cupertino, CA (US)

(72) Inventors: David M. Pelletier, Cupertino, CA (US); Brad G. Boozer, Cupertino, CA (US); Colin M. Ely, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/136,868

(22) Filed: Apr. 22, 2016

Related U.S. Application Data

(60) Provisional application No. 62/151,883, filed on Apr. 23, 2015.

(51) Int. Cl.

| | |
|---|---|
| ***H01H 3/12*** | (2006.01) |
| ***H01H 13/14*** | (2006.01) |
| ***H01H 13/06*** | (2006.01) |
| ***H01H 11/00*** | (2006.01) |

(52) U.S. Cl.
CPC ..... *H01H 13/06* (2013.01); *H01H 11/00* (2013.01)

(58) Field of Classification Search
CPC .... H01H 13/06; H01H 11/00; H01H 2231/00; H01H 2231/002; H01H 2231/016; H01H 2231/022; H01H 2239/034; H01H 2227/036; H01H 2215/012; H01H 2223/03; H01H 13/70; H01H 2221/026; H01H 3/02; H01H 3/00; H01H 3/12; H01H 9/00; H01H 9/02; H01H 9/04; H01H 9/041; H01H 13/00; H01H 13/04; H01H 13/26; H01H 13/50; H01H 2003/02; H01H 2003/12; H01H 2223/00; H01H 2223/002; H01H 2223/01; H01H 2223/04; H01H 2223/044
USPC ..... 200/5 A, 341; 378/286, 287, 289, 290, 378/291, 316
See application file for complete search history.

(56) References Cited

U.S. PATENT DOCUMENTS

| | | | |
|---|---|---|---|
| 2,866,141 | A | 12/1958 | Frank et al. |
| 4,022,296 | A | 5/1977 | Mandel et al. |
| 4,022,993 | A | 5/1977 | Shattuck |
| 4,037,068 | A | 7/1977 | Gaynor |
| 4,258,096 | A | 3/1981 | LaMarche |
| 4,324,956 | A | 4/1982 | Sakakino et al. |
| 4,345,119 | A | 8/1982 | Latasiewicz |
| 4,581,509 | A | 4/1986 | Sanford et al. |
| 4,922,070 | A | 5/1990 | Dorkinski |
| 5,081,329 | A | 1/1992 | Mitusinski et al. |
| 5,258,592 | A | 11/1993 | Nishikawa et al. |
| 5,584,380 | A | 12/1996 | Naitou |
| 5,657,012 | A | 8/1997 | Tait |
| 5,760,351 | A | 6/1998 | Tsai |

(Continued)

FOREIGN PATENT DOCUMENTS

| | | |
|---|---|---|
| EP | 2720129 | 4/2014 |
| JP | 3034908 | 3/1997 |

(Continued)

*Primary Examiner* — Anthony R. Jimenez
(74) *Attorney, Agent, or Firm* — Dorsey & Whitney LLP

(57) ABSTRACT

A sealed button assembly including a button cap, a push rod, a button retainer, and a bracket is described. The bracket can couple to the button retainer which itself can interlock with the button cap and push rod through a counterbore, the counterbore being defined in a sidewall of the housing of an electronic device.

27 Claims, 7 Drawing Sheets

(56) References Cited

U.S. PATENT DOCUMENTS

| | | | |
|---|---|---|---|
| 5,881,866 | A | 3/1999 | Miyajima et al. |
| 5,898,147 | A | 4/1999 | Domzalsi et al. |
| 6,344,791 | B1 | 2/2002 | Armstrong |
| 6,355,891 | B1 | 3/2002 | Ikunami |
| 6,492,602 | B2 | 12/2002 | Asai et al. |
| 6,525,278 | B2 | 2/2003 | Villain et al. |
| 6,924,448 | B2 | 8/2005 | Sera et al. |
| 6,963,039 | B1 | 11/2005 | Weng et al. |
| 7,119,289 | B2 | 10/2006 | Lacroix |
| 7,605,338 | B2 | 10/2009 | Karaki et al. |
| 7,851,717 | B2 | 12/2010 | Tatehata et al. |
| 8,134,094 | B2 | 3/2012 | Tsao et al. |
| 8,167,126 | B2 | 5/2012 | Stiehl |
| 8,248,815 | B2 | 8/2012 | Yang et al. |
| 8,263,886 | B2 | 9/2012 | Lin et al. |
| 8,263,889 | B2 | 9/2012 | Takahashi et al. |
| 8,431,849 | B2 | 4/2013 | Chen |
| 8,432,368 | B2 | 4/2013 | Momeyer et al. |
| 8,446,713 | B2 | 5/2013 | Lai |
| 8,576,044 | B2 | 11/2013 | Chapman |
| 8,648,829 | B2 | 2/2014 | Shahoian et al. |
| 8,885,856 | B2 | 11/2014 | Sacha |
| 9,064,654 | B2 | 6/2015 | Whitt et al. |
| 9,089,049 | B2 | 7/2015 | Perrault et al. |
| 9,510,468 | B2 | 11/2016 | Schack et al. |
| 9,871,330 | B2 | 1/2018 | Seo et al. |
| 9,916,942 | B2 | 2/2018 | Shedletsky |
| 2004/0082414 | A1 | 4/2004 | Knox |
| 2007/0152959 | A1 | 7/2007 | Peters |
| 2007/0235307 | A1* | 10/2007 | Liao ..... H01H 3/125 200/314 |
| 2008/0049980 | A1 | 2/2008 | Castaneda et al. |
| 2009/0312051 | A1 | 12/2009 | Hansson et al. |
| 2012/0067711 | A1 | 3/2012 | Yang |
| 2013/0037396 | A1 | 2/2013 | Yu |
| 2013/0087443 | A1 | 4/2013 | Kikuchi |
| 2014/0048400 | A1* | 2/2014 | Malek ..... H01H 13/06 200/517 |
| 2014/0233360 | A1* | 8/2014 | Koshoji ..... G04B 37/106 368/290 |
| 2015/0199011 | A1 | 7/2015 | Fukumoto et al. |
| 2015/0221460 | A1 | 8/2015 | Teplitxky et al. |
| 2015/0228423 | A1 | 8/2015 | Sanford et al. |
| 2016/0100499 | A1 | 4/2016 | Jung et al. |
| 2016/0313703 | A1 | 10/2016 | Ely et al. |
| 2017/0069443 | A1 | 3/2017 | Wang et al. |
| 2017/0069444 | A1 | 3/2017 | Wang et al. |
| 2017/0069447 | A1 | 3/2017 | Wang et al. |

FOREIGN PATENT DOCUMENTS

| | | | |
|---|---|---|---|
| JP | 3034908 U | * | 3/1997 |
| KR | 20080045397 | | 5/2008 |

* cited by examiner

THIN PROFILE SEALED BUTTON ASSEMBLY

CROSS-REFERENCE TO RELATED APPLICATIONS

This application is a non-provisional patent application of, and claims the benefit to, U.S. Provisional Patent Application No. 62/151,883, filed Apr. 23, 2015, and titled "Thin Profile Sealed Button Assembly," the disclosure of which is hereby incorporated herein by reference in its entirety.

FIELD

Embodiments described herein generally relate to input devices and, more particularly, to thin-profile sealed button assemblies.

BACKGROUND

An electronic device can include one or more buttons. A button may be disposed within an aperture defined in the housing of the electronic device. In some cases, a seal may be provided between the button and the aperture in order to prevent or mitigate any intrusion of foreign matter to the interior of the electronic device through the aperture.

Button assemblies typically include a protrusion extending from a button cap to engage an electrical switch. The protrusion is conventionally formed as an integral part of the button cap. Such a configuration can abrade the top surface of the electrical switch. For example, an off-axis application of force to the button cap causes the button cap to pivot, torquing the protrusion, and causing it to laterally draw across the surface of the electrical switch. Repeated abrasion of the electrical switch reduces the operational life of the button assembly and an electronic device incorporating the same. Additionally, repeated abrasion can reduce the effectiveness of seals, and thus the operational life, of the button assembly and the electronic device.

SUMMARY

Embodiments described herein reference a button assembly mechanically coupling a button cap to an electrical switch via a push rod. In these and related embodiments, the button assembly includes a button cap (or, generally, a "cap"), a button retainer (or, generally, a "retainer" or "cap retainer"), a push rod disposed within a through-hole of the button retainer, and a bracket.

The button cap is positioned over the button retainer and an electronic switch is positioned below the retainer and aligned with the push rod. Thereafter, the bracket fastens to the button retainer to form the assembled button assembly. In many embodiments, the bracket couples to the button retainer in a manner that clamps to a portion of the electronic device housing. For example, the electronic device housing defines a counterbore having a small-diameter through-hole about which the circular button assembly is affixed. In such an embodiment, the button cap and button retainer is positioned (at least partially) within the counterbore volume, and the bracket is placed behind the small-diameter through-hole within the housing. The bracket is, thereafter, fastened to the button retainer through the small-diameter through-hole. In this manner, the button retainer and bracket can clamp around the floor of the counterbore.

In other examples, an electronic device housing defines an arbitrarily-shaped inset surface associated with a smaller arbitrarily-shaped through-hole therein. In an alternative non-limiting phrasing, an electronic device housing defines a button aperture with a shelf or ledge extending from the interior sidewalls thereof. In these embodiments, the button retainer and bracket can clamp around the floor of the arbitrarily-shaped inset or about the shelf and/or ledge in order to securely fasten to the electronic device.

In many embodiments, the push rod can has a length greater than a thickness of the button retainer. The electronic switch is braced and/or supported by the retainer such that when the push rod axially translates within the through-hole (and toward the electronic switch) in response to a press, a downward force provided by the push rod is focused onto the electronic switch, causes the electronic switch to activate.

In many cases, the bracket is fastened to the button retainer via a mechanical fastener (e.g., screws, rivets, snaps, and so on). In other cases, the bracket is fastened to the button retainer via a permanent or semi-permanent mechanical fastening means (e.g., solder, sonic or laser weld, adhesive, and so on).

In many embodiments, a seal (e.g., ring seal, gasket seal, caulking, and so on) is positioned around the push rod so as to seal the gap between the push rod and the sidewalls of the through-hole. In many cases, the seal may provide a liquid-impermeable seal between the push rod and the sidewalls of the through-hole. Additionally, one or more seals is disposed between the surfaces either (or both) of the button retainer and the bracket that clamp to the counterbore or shelf of the housing. As with the ring seal disposed about the push rod, the one or more seals associated with the button retainer and the bracket provide a liquid-tight seal.

The cooperation of the ring seal, associated with the push rod, and the seal(s) associated with either (or both) of the bracket and the button retainer provide the electronic device with a sealed barrier that prevents intrusion of foreign matter (e.g., liquid, dust, organic or inorganic debris, and so on) without considerably impacting the tactile feel, responsiveness, or functionality of the electronic switch.

The total thickness of the sealed button assembly, when affixed to an electronic device, is not substantially larger than the thickness of the sidewall of the housing of the electronic device itself. In this manner, sealed button assemblies as described herein is formed with substantially thin cross-sectional profiles.

Additionally, as a result of the clamping configuration of the bracket, shelf, and button retainer, specialized machining of fastening features within the housing of an electronic device is not required (e.g., screw taps, snap-fit geometry, and so on). More particularly, conventional button assemblies often require time-consuming milling, machining, and/or finishing (e.g., thread milling, undercutting, fixture adhesion processes, and so on) of the electronic device housing in order to provide fastening features to which the conventional button assembly attaches. The time required to provide or form fastening features for an electronic device housing may increase as the size of the electronic device housing decreases. More particularly, small electronic device housings, especially ones including curved or rounded sections, can be difficult to manipulate or maneuver with sufficient precision so as to provide fastening features thereto. In other words, it is difficult and/or time or cost prohibitive to manufacture small form-factor electronic devices with fastening features for conventional button assemblies.

Accordingly, many embodiments described herein reference a sealed button assembly having a thin cross-sectional profile that clamps to a shelf or counterbore portion of an electronic device housing. As fastening features within the electronic device are not required for such embodiments, such a sealed button assembly is manufactured and assembled in a time and cost effective manner without regard to the size or form-factor of the electronic device.

In many cases, the button cap includes an undercut (e.g., defined by an inwardly-extending flange, hook, shelf, ledge, and so on) that is configured to interlock with a wing (e.g., outwardly-extending flange, hook, shelf, ledge, and so on) of the button retainer. Such embodiments can also include a compressible biasing member (e.g., spring, elastomer, spring bar, and so on) disposed to bias the button cap outwardly from the button retainer. In many cases, one or more properties (e.g., dimensions, materials, surface finishes, and so on) of the button retainer, the biasing member, and the button cap are selected such that, when assembled, the button cap extends proud of an external surface of the housing to which the button assembly is coupled.

In some embodiments, the button cap has a flat-bottomed surface that interfaces with the button retainer, although this is not required. For example, the button cap can have a scalloped bottom surface, a dished bottom surface, a patterned bottom surface, or any other suitable bottom surface. Thus, generally and broadly, interior surface(s) of the button cap can take any number of suitable shapes or can have any number of suitable surface finishes.

In some embodiments, the wing of the button retainer can interlock with the button cap by rotating the button cap to position the wing of the button retainer within the undercut of the button cap. In other cases, the button retainer can interlock with the button cap by sliding the wing of the button retainer below the undercut of the button cap. In still further examples, the button retainer can interlock with the button cap by snapping the wing of the button retainer into the undercut. In many of these examples, after interlocking the button cap with the button retainer, a longitudinal axis of the button cap is aligned substantially parallel with a longitudinal axis of the button retainer.

For some embodiments described herein the button cap is formed as a rounded rectangle. In these and other embodiments, the button cap is finished with a manufacturing process selected to provide a desirable cosmetic finish to an external surface of the button cap. For example, the button cap can be finished with a chamfered perimeter edge. In some embodiments, the button cap can be polished to a mirror finish, or can be formed or finished with a matte finish. In some examples, a symbol, glyph, or other informational graphic is disposed onto the external surface of the button cap. For example, in some embodiments a laser ablation process is used to etch an information graphic related to the functionality of the button into the external surface of the button cap. In other examples, an informational graphic is formed by depositing ink onto the external surface of the button cap.

Embodiments described herein may also relate to, include, or take the form of a method for assembling a sealed button including at least the operations of selecting a cap with an undercut and a push rod recess, selecting a push rod with a seal channel, selecting a retainer which defines a through-hole proportioned to receive the push rod therethrough, positioning a seal around the push rod and at least partially within the seal channel, positioning the push rod within the through-hole, positioning the cap over the retainer such that the push rod is at least partially received within the push rod recess interlocking the undercut and the wing, positioning the cap, push rod, and button retainer over an external surface adjacent to an aperture defined in a housing of an electronic device, positioning a bracket over an internal surface adjacent to the aperture, and fastening the bracket to the retainer through the aperture such that at least a portion of the electronic device housing interposes the bracket and the retainer.

BRIEF DESCRIPTION OF THE FIGURES

Reference will now be made to representative embodiments illustrated in the accompanying figures. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

The use of the same or similar reference numerals in different figures indicates similar, related, or identical items.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalties of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

A water-tight button assembly having a thin profile for use with a portable electronic device is disclosed. The button assembly includes a button cap, a button retainer to interlock with the button cap, a spring between the button retainer and the button cap to bias the button cap away from the button retainer, a push rod disposed within a through-hole of the button retainer, and a bracket. The bracket and the button retainer clamp around a gasket to a base of a counterbore within a housing of the portable electronic device, providing a liquid-impermeable barrier between the button retainer and the interior of the housing.

Additionally, an O-ring seal is positioned around the push rod to provide a liquid-impermeable barrier between the push rod and sidewalls of the through-hole of the button retainer. An electrical switch within the housing is adjacent to the push rod. When the button cap is pressed, the push rod transfers a force from the button cap to the electrical switch to cause the electrical switch to activate. Separation of the button cap and the push rod prevents the water-tight button assembly from experiencing torque. Cooperation of the gasket and the O-ring prevents water and other liquids from entering the housing and interfering with the operation of the electrical switch or other components of the portable electronic device.

The button assemblies described herein implement a button cap configured to pivot about, but not with, a push rod interacting with an electrical switch. The push rod may translate forces received at the button cap to the electrical switch to cause the electrical switch to close, regardless whether the force applied to the button cap causes the button cap itself to pivot or rotate.

Figure 1A:
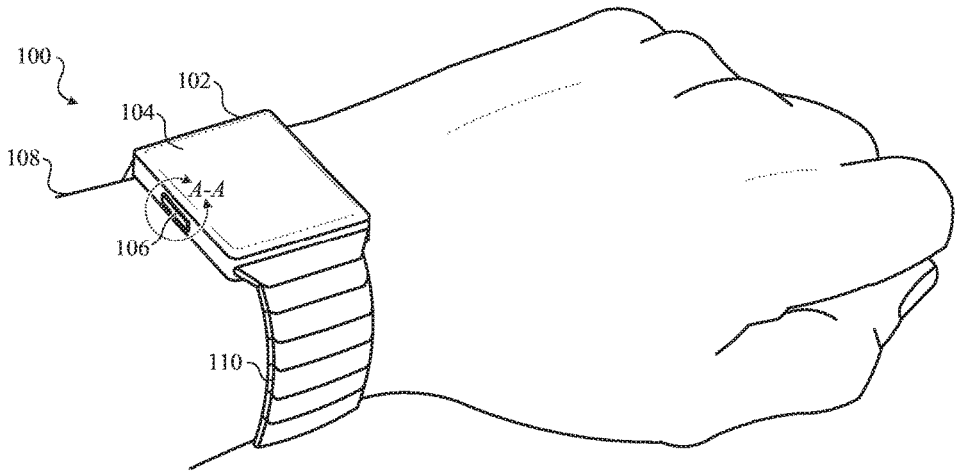
FIG. 1A depicts an example electronic device incorporating a sealed button assembly, in accordance with embodiments described herein.

FIG. 1A depicts an example electronic device incorporating a sealed button assembly, as generally described above and as described below with more particularity with respect to FIGS. 2A-5. The electronic device shown in FIG. 1A may be a wearable electronic device 100 such as a timekeeping device. The wearable electronic device 100 can include a housing 102 to enclose components (such as electrical and mechanical components) of the wearable electronic device 100. The housing 102 can, at least partially, surround a display 104. Additionally, the wearable electronic device 100 can incorporate one or more input elements or mechanisms to facilitate user interaction. For example, the wearable electronic device 100 can include one or more of a speaker, a rotary input device, a microphone, and/or a button 106, depicted in a removed view of greater scale in FIG. 1B.

Generally, the button 106 is formed to take a substantially rectangular shape having at least partially rounded endcaps, although such a configuration is not required of all embodiments and other buttons may take other forms. For example, a button 106 can take a circular, rectangular, square, faceted, smooth, or any other arbitrary shape.

The button 106 is disposed within a button aperture defined in the housing 102. In some examples, the button 106 can form a substantially continuous surface with the housing 102. The button 106 can be substantially flush with the external surface of the housing 102. In some embodiments, the button 106 can protrude from the housing 102 such that an external surface of the button 106 is proud of the external surface of the housing 102.

Figure 1B:
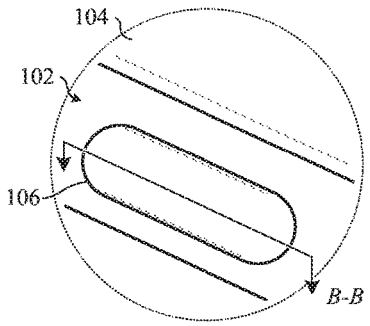
FIG. 1B depicts a detail view of the region A-A depicted in FIG. 1A.
Figure 2A:
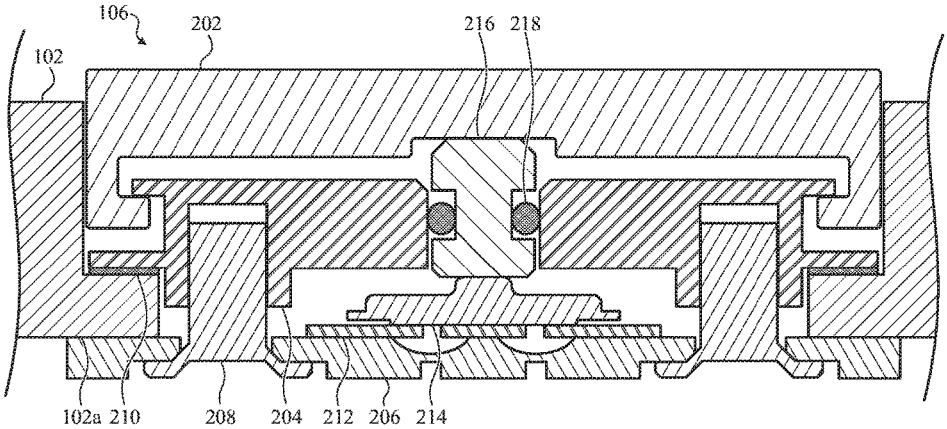
FIG. 2A depicts a cross-section view of the sealed button assembly of FIG. 1B taken through section B-B of FIG. 1B.

FIG. 2A depicts a cross-section view of the sealed button assembly of FIG. 1B taken through section B-B. Portions (or a majority) of the button 106 can be positioned within a counterbore and affixed to a ledge 102*a* (or floor) of the counterbore defined within the housing 102 of the wearable electronic device 100. As used herein, the term "counterbore" generally refers to both cylindrical counterbores associated with coaxially-aligned smaller-diameter through-holes and additionally to non-cylindrical inset surfaces that take the general form of an arbitrarily-shaped aperture associated with a continuous or non-continuous ledge (or other shelf or protrusion) that extends proud of sidewalls of the aperture (e.g., extending into the aperture itself). As noted with respect to the description of the button 106 as depicted in FIG. 1B, the button 106 can take a substantially rectangular shape having rounded endcaps. Accordingly, the counterbore defined within the housing 102 of the wearable electronic device 100 can take substantially the same shape.

Generally, the button 106 can include a button cap 202, a button retainer 204, and a bracket 206. The button cap 202 is retained at least partially in the counterbore in the housing by the button retainer 204, as discussed in more detail below, and is biased away from the button retainer 204 by one or more compressible biasing members (see, e.g., FIG. 2B). Further, the button cap 202 abuts or is adjacent to a first end of a push rod 216, which may extend through the button retainer 204. A second end of the push rod 216 may abut or be disposed near an electrical switch, such as a dome switch. The dome switch may be affixed to the bracket 206. One or more fasteners such as the screws 208 may affix the bracket 206 to the button retainer 204 to clamp the button 106 to the housing 102 around the ledge 102*a*. A gasket seal 210 may be positioned between an extension or underside of the button retainer 204 and the ledge 102*a* of the counterbore.

The button cap 202 can take a shape such as a circular, rectangular, or square shape. The button cap 202 can have a planar top surface, although this is not required. For example, the button cap 202 can have a curved top surface that follows a curved profile of the housing 102. In some cases, the button cap 202 can have a chamfered perimeter edge and/or can be cosmetically finished to a mirror or matte surface. In some examples, a symbol, glyph, or other informational graphic can be disposed onto the external surface of the button cap 202. For example, in some embodiments a laser ablation process can be used to etch an information graphic related to the functionality of the button into the external surface of the button cap. In other examples, an informational graphic can be formed by depositing ink onto the external surface of the button cap. The button cap 202 is positioned adjacent to the push rod 216 and to the button retainer 204 and within the counterbore.

The gasket seal 210 can be positioned between the button retainer 204 and a floor of the counterbore within the housing 102. The gasket seal 210 can be formed from any number of suitable materials. For example, the gasket seal 210 can be formed from a pressure sensitive adhesive, a compressible and close-cell foam, a low-durometer elastomer such as silicone, or a fluoroelastomeric material.

The gasket seal 210 can be disposed about the entire perimeter of the floor of the counterbore defined in the housing 102. Alternatively, the gasket seal 210 can be disposed at select locations about the perimeter of the floor of the counterbore. In still further examples, the gasket seal 210 can be formed from a series of layered or stacked materials. For example, a layer of pressure sensitive adhesive can be disposed below a layer of low-durometer elastomer.

In other examples, the gasket seal 210 can be formed from a series of concentric seals. For example, an outer gasket seal portion can be separate and distinct from an inner gasket seal portion. In these embodiments, an outer gasket seal can be formed from the same or a different material as the inner gasket seal portion.

In still further embodiments, the gasket seal 210 can take the form of a curable liquid adhesive. In such embodiments, the gasket seal 210 may provide an effective seal between the button retainer 204 and the floor of the counterbore defined in the housing 102 after the gasket seal 210 is cured. In these embodiments, the curable liquid can be disposed in a manner and in such a volume so as to seep (via capillary action or another mechanism) into any irregularities within either the floor of the counterbore defined in the housing 102 or in the button retainer 204 itself. In these and related embodiments, the gasket seal 210 can provide a structurally-sound bond between the counterbore and the button retainer 204.

Furthermore, although the gasket seal 210 seal is illustrated as substantially planar, such a configuration is not required for all embodiments. For example, the gasket seal 210 can contour to a geometry of the underside of the button retainer 204 or to the floor of the counterbore defined in the housing 102. The button retainer 204 can include one or more surface features configured to increase the bond strength between the button retainer 204 and the gasket seal 210. The lower surface of the button retainer 204 can be rough or otherwise irregular. In other examples, the lower surface of the button retainer 204 may be a serrated shape and the gasket seal 210 may be similarly shaped.

Additionally, although the gasket seal 210 is illustrated as terminating at an edge of the button retainer 204, such a configuration is not required. For example, the gasket seal 210 can wrap around the lower surface of the button retainer 204, such that the gasket seal 210 interfaces with the button retainer 204, the floor of the counterbore, and one or more sidewalls of the counterbore.

The combination of the seal 218 and the gasket seal 210 can provide the wearable electronic device with a sealed barrier that prevents intrusion of foreign matter (e.g., liquid, dust, organic or inorganic debris, and so on) without considerably impacting the tactile feel, responsiveness, or functionality of the electronic switch.

The bracket 206 can be mechanically fastened to the button retainer 204 with one or more mechanical fasteners, illustrated in FIG. 2A as the screws 208. In some embodiments, other fasteners or fastener types may be used such as, but not limited to, bolts, rivets, nails, or the like. In some embodiments the bracket 206 can be mechanically fastened to the button retainer 204 by an adhesive, a welded joint, or a combination thereof. Alternately, the bracket 206 can be over-molded onto the button retainer 204. In still further examples, the bracket 206 or a portion thereof can be caused to reflow into one or more apertures or cavities of the button retainer 204, thereby affixing the bracket 206 to the button retainer 204 in a permanent or semi-permanent manner.

The screws 208 can have the same number of threads per millimeter as a tapped portion of a screw cavity defined within the button retainer 204. In these examples, the screws 208 can be driven into the screw cavity or cavities of the button retainer 204 upon assembly of the button 106. In some embodiments, the threads of the screws 208 and/or the threads of the tapped portion of the screw cavity defined within the button retainer 204 can be partially coated with a thread locking adhesive. In some embodiments, the screws 208 can be self-tapping.

The bracket 206 can include one or more countersinks in order to allow the head of the screws 208 to be substantially flush with the bracket 206. However, in some embodiments, such a configuration may not be required. In such embodiments, head portions of the screws 208 can be proud of the bracket 206 when the screws 208 are fully driven into the button retainer 204.

The electrical switch can be formed on a substrate 212 and take the form of a compressible dome 214 that is positioned above the bracket 206 and below the button retainer 204. The substrate 212 can provide structural definition and support to the compressible dome 214. In many examples, the substrate 212 can be formed from a rigid material such as metal. In some embodiments, the substrate 212 can be formed from a circuit board or other similar material. In still further embodiments, the substrate 212 can be formed from a plastic. The substrate 212 can include one or more vents to provide an air displacement path for the compressible dome 214.

In many examples, the substrate 212 can have one or more electrical traces disposed on a top surface thereof. The electrical traces can cooperate with a conductive portion of the compressible dome 214 to complete one or more electrical circuits when the compressible dome 214 compresses. In other examples, the electrical traces can be coupled to an electrical circuit configured to monitor the electrical traces for changes in electrical properties. For example, the electrical circuit can monitor for capacitive changes, resistive changes, reactive changes, inductive changes, and so on.

In other examples, the substrate 212 can be coupled to one or more flexible circuits. A flexible circuit can host any number of electrical components related to the operation of the electrical switch or related to the operation of a circuit separate from the electrical switch. In many examples, a flexible circuit can couple the button 106 with one or more separate circuits within the wearable electronic device. More particularly, a flexible circuit can be used to couple the electrical switch to a processor or circuit configured to monitor the electrical switch for a button press.

The push rod 216 can couple an electrical switch (described below) to the button cap 202. The push rod 216 can be disposed within a through-hole (e.g., aperture, hole, opening, and so on) of the button retainer 204. The through-hole of the button retainer 204 and the push rod 216 can be formed so that the push rod 216 can axially translate within the through-hole. More particularly, the push rod 216 can move both upwardly and downwardly within the through-hole.

In this manner, when the button cap 202 is pressed by a user, a downward force can be applied through the push rod 216 to the compressible dome 214. In response thereto, the compressible dome 214 can collapse, activating the electrical switch. A signal that the electrical switch is activated can then be conveyed to the wearable electronic device.

As noted above and as illustrated, the push rod 216 may interface with both the compressible dome 214 of the electrical switch and an internal surface of the button cap 202, although this configuration may not be required for all embodiments. In many cases, and as illustrated, the button cap 202 can incorporate a recess into which a top surface of the push rod 216 can be disposed.

A seal 218 can be positioned around a body portion of the push rod 216. In some cases, the body portion of the push rod 216 can include a channel within which the seal 218 is at least partially disposed. For example, as illustrated, the seal 218 can be an annular seal (e.g., O-ring) that is sized to touch and/or compress against both the interior of the through-hole of the button retainer 204 and the push rod 216.

In some examples, the seal 218 can be placed into tension when applied to the push rod 216. For example, the seal 218 can be formed into an O-ring shape from an elastomeric material (e.g., as fluoroelastomer, polymer, and so on). During assembly of the button 106, the seal 218 can be stretched over the push rod 216.

In some embodiments, the seal 218 can at least partially rotate or move in response to the axial translation of the push rod 216. In this manner, the seal 218 can also function as a type of bearing that at least partially guides the axial translation of the push rod 216 through the through-hole of the button retainer 204.

In many embodiments, the push rod 216 can have a length that is greater than a thickness of the button retainer 204 such that the push rod 216 can axially translate within the through-hole of the button retainer 204 in order to transfer a force received at the button cap 202 to the compressible dome 214 of the electronic switch disposed below the button retainer 204. The electronic switch may be braced and/or supported by the retainer such that, when the push rod 216 axially translates within the through-hole (and toward the electronic switch) in response to a press, a downward force provided by the push rod 216 may be focused onto the electronic switch, which in turn may activate the electronic switch.

A depth of the button 106 may not be substantially larger than a thickness of the sidewall of the housing 102. More particularly, the only portion of the button 106 protruding into the interior volume of the housing 102 may be the bracket 206. Accordingly the thickness of the bracket 206 may be selected or determined at least in part in view of the internal layout of other components within the wearable electronic device.

Retention of the button cap 202 by the button retainer 204 will now be discussed. As noted with respect to embodiments described herein, the button cap 202 can include an undercut defined by a flange extending from a sidewall of the button cap 202. The undercut may accept and interlock with a wing of the button retainer 204. The sizing and spacing of the wing and the undercut can define the travel distance of the button cap 202 when the button cap 202 is pressed by a user. Additionally, the interlocking relationship between the wings and the undercuts can allow the button retainer 204 to retain the button cap 202 in a button aperture defined in the housing 102. More particularly, when the button 106 is installed within the counterbore of the housing 102, the button cap 202 may not be easily removed.

One may appreciate that similar retention may occur if the button cap 202 were formed with one or more wings and, correspondingly, the button retainer 204 were formed with one or more undercuts. Some embodiments may implement the button cap 202 and the button retainer 204 in this manner. However, forming of the button cap 202 with undercuts (e.g., as illustrated) causes the button cap 202 to occupy a larger proportion of the volume defined by the counterbore than if the button cap 202 were to be formed with wings instead. The illustrated configuration may prevent or mitigate the accumulation or ingress of foreign matter into the counterbore volume, may provide for a more structurally sound and rigid structure for the button cap 202, and/or may provide a smoother and more linear downward travel for the button cap 202.

As noted above, the wing of the button retainer 204 can interlock with the button cap 202 by rotating the button cap 202 (prior to placement of the button 106 in the counterbore of the housing 102) to position the undercut of the button cap 202 below the wing of the button retainer 204. In other cases, the button retainer 204 can interlock with the button cap 202 by sliding the undercut below the wing of the button retainer 204. In still further examples, the button retainer 204 can interlock with the button cap 202 by snapping the undercut over the wing of the button retainer 204.

Also as noted above, as a result of the clamping configuration of the bracket 206 and button retainer 204 around the floor of the counterbore defined in the housing 102, specialized machining of fastening features within the housing 102 may not be required. As one example, conventional button assemblies often require time-consuming milling, machining, and/or finishing (e.g., thread milling, undercutting, fixture adhesion processes, and so on) of the electronic device housing in order to create fastening features for which the conventional button assembly can attach. The time required to create fastening features for an electronic device housing may increase as the size of the electronic device housing decreases. More particularly, small electronic device housings such as the housing 102 of the wearable electronic device 100 (shown in FIG. 1A), may be difficult to manipulate or maneuver with sufficient precision so as to create fastening features thereto. Embodiments described herein are not so limited and may be readily affixed in a cost- and time-efficient manner to housings of electronic devices.

Figure 2B:
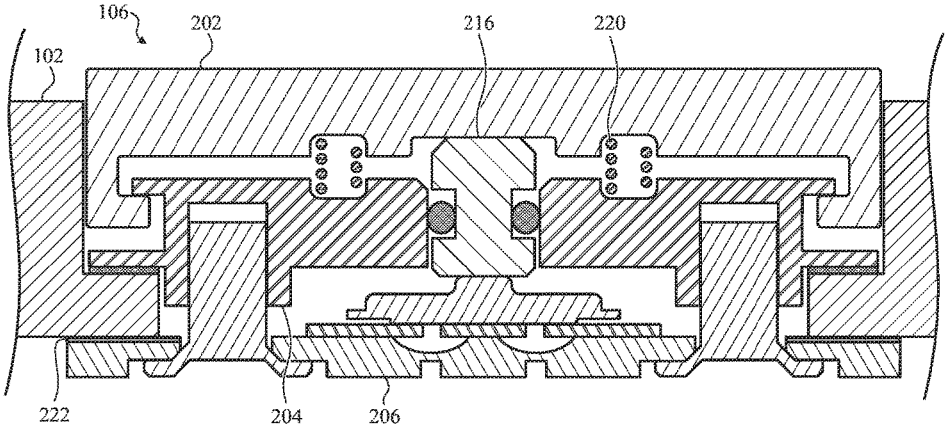
FIG. 2B depicts a cross-section view of the sealed button assembly of FIG. 1B taken through section B-B, depicting the sealed button assembly with a button cap biasing mechanism.

Further embodiments can incorporate additional features. For example, FIG. 2B depicts a cross-section view of the sealed button assembly of FIG. 1B taken through section B-B depicting the sealed button assembly with a button cap biasing mechanism. As with the embodiment depicted in FIG. 2A, the button 106 shown in FIG. 2B is disposed within a counterbore defined by the housing 102 of the wearable electronic device 100 of FIGS. 1A-1B. The button 106 can likewise include a button cap 202 positioned above a button retainer 204 which is coupled to the housing 102 via a bracket 206.

In addition, the embodiment depicted in FIG. 2B includes a compressible biasing member 220 (e.g., spring, elastomer, spring bar, and so on) disposed between the button cap 202 and the button retainer 204. The compressible biasing member 220 can bias the button cap 202 away from the button retainer 204. The compressible biasing member 220 can provide an even biasing force to the button cap 202 so that the button cap 202 is substantially level when biased. For example, the compressible biasing member 220 is illustrated as two springs under tension, providing an upwardly biasing force equally distributed on opposite sides of the push rod 216, maintaining a separation between the button cap 202 and the button retainer 204. In this example, the compressible biasing member 220 can provide resistance to the button cap 202 pivoting or rotating in response to an off-axis button press.

In other embodiments the compressible biasing member 220 can be positioned elsewhere. For example, the compressible biasing member 220 can be positioned between the push rod 216 and the button cap 202 or between the push rod 216 and the electronic switch. In other examples, the compressible biasing member 220 can be positioned in other locations.

In many cases, one or more properties (e.g., dimensions, materials, surface finishes, and so on) of the button retainer 204, the compressible biasing member 220, and the button cap 202 can be selected such that, when assembled, the button cap 202 extends proud of an external surface of the housing to which the button assembly is coupled.

Although the compressible biasing member 220 is illustrated as two separated springs, some embodiments can implement the compressible biasing member 220 in another manner. For example, in some cases the compressible biasing member 220 can be implemented as a compressible foam disposed between the button cap 202 and the button retainer 204. In another example, the compressible biasing member 220 can be implemented as a flexible elastomer on the underside of the button cap 202 or an upper surface of the button retainer 204. In still further examples, the compressible biasing member 220 can be implemented as a single spring which may wrap around the push rod 216. In further embodiments, the compressible biasing member 220 can be implemented as a spring bar, leaf spring, or other resilient material.

Although the button cap 202 is illustrated as abutting a top surface of the push rod 216, such a configuration is not required. For example, the compressible biasing member 220 may cause the button cap 202 to lift above the top surface of the push rod 216. Some embodiments may implement the button cap 202 and the compressible biasing member 220 in this manner. However, the embodiment illustrated in FIG. 2B may provide a stronger and constant tactile feel to a user upon pressing the button cap 202.

Additionally, the embodiment depicted in FIG. 2B can include a rigid shim 222 that can be disposed between the bracket 206 and an internal portion of the housing 102. The rigid shim 222 can bias the bracket 206 into the volume of the housing 102. In this manner, the rigid shim 222 can provide an increased pull force on the button 106, drawing the button 106 into the housing 102.

In some embodiments, the rigid shim 222 can be formed from metal. In these cases, the rigid shim 222 can add strength to the bracket 206. In some embodiments, the rigid shim 222 can be formed from multiple layers of material. In some examples, the rigid shim 222 can be formed from a metal layer and a foam layer. In these cases, the foam layer may face and abut the bracket 206. In some examples, the rigid shim 222 can be formed from a metal layer and an adhesive layer. In these embodiments, the adhesive may partially compress upon fastening the bracket 206 to the button retainer 204.

In some embodiments, the foam layer of the rigid shim 222 may be oriented to interface the housing 102. One may appreciate that the thickness of the rigid shim 222 can vary from embodiment to embodiment. Further, one may appreciate that a particular shim may be selected for a particular device during a manufacturing process.

Figure 3A:
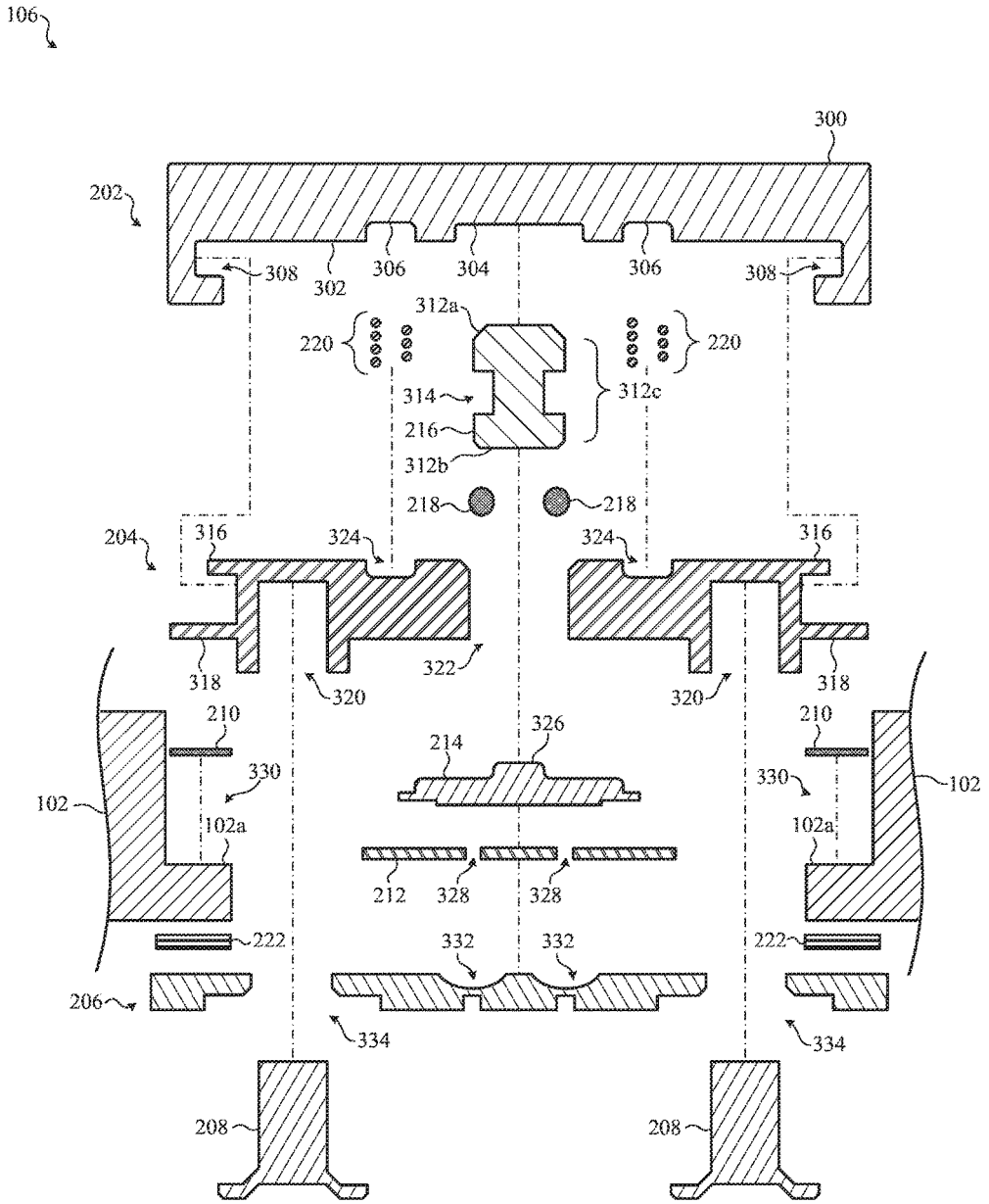
FIG. 3A depicts an exploded cross-section assembly view of the sealed button assembly of FIG. 2B.

FIG. 3A depicts an exploded cross-section assembly view of the button 106 of FIG. 2B. To facilitate an understanding of the various features and elements labeled in FIG. 3A, and to simplify the description thereof, detailed descriptions related to features of the button 106 described with reference to FIGS. 2A-2B are not repeated below. Additionally, the assembly guide lines depicted in FIG. 3A are merely presented to illustrate an approximate final assembled position of the various elements depicted; the assembly guide lines are not presented to illustrate a preference or requirement for a particular installation orientation, direction, path, or method.

The button cap 202 can include an exterior surface 300 and an interior surface 302. The exterior surface 300 of the button cap 202 be substantially planar. In some embodiments, the exterior surface 300 can take another shape, such as a rounded shape or a faceted shape. The exterior surface 300 can provide cosmetic or functional features for the button cap 202. For example, the exterior surface 300 can be polished to a mirror finish. In some embodiments, the exterior surface 300 can have a matte finish. In such a case, the exterior surface 300 of the button cap 202 can be polished in a first manufacturing stage and, thereafter, can be subjected to a particle blast in a second manufacturing stage to provide a matte finish. In many examples, the exterior surface 300 of the button cap 202 can be flush with a top surface of the housing 102 of the wearable electronic device 100. In other cases, the exterior surface 300 of the button cap 202 can sit proud of a top surface of the housing 102.

The interior surface 302 of the button cap 202 can define a push rod recess 306 (e.g., push indentation, push rod detent, push rod detent, and so on). The interior surface 302 of the button cap 202 can also define one or more bias indentations 324 configured to receive and/or guide the placement of the compressible biasing member 220 between the button cap 202 and the button retainer 204. The interior surface 302 of the button cap 202 can cooperate with sidewalls of the button cap 202 and flanges extending inwardly therefrom to define the undercuts 308. For example, flanges can extend from lateral sidewalls of the button cap 202 toward a centerline of the button cap 202. The distance the undercuts 308 extend toward the centerline of the button cap 202 can vary from embodiment to embodiment. Additionally, although the undercuts 308 are illustrated as taking a substantially rectilinear shape, such a configuration is not required for all embodiments. For example, the undercuts 308 may be defined to take an arced shape. In other embodiments, the undercuts 308 can be defined to take an arbitrary shape.

The push rod 216 can also have multiple features. For example, the push rod 216 can include a top surface 312*a* and a bottom surface 312*b* that are joined by a body portion 312*c*. In many embodiments, the top surface 312*a* of the push rod 216 can interface with the interior surface 302 of the button cap 202. In some embodiments, the top surface 312*a* of the push rod 216 can sit within the push rod recess 306. Also, the bottom surface 312*b* of the push rod 216 can abut the electronic switch positioned therebelow. In many cases, either or both of the top surface 312*a* or the bottom surface 312*b* can be finished with a chamfered or otherwise rounded edge.

Within the body portion 312*c* of the push rod 216 can be a seal channel 314 that is sized and configured to receive (and retain) the seal 218. Although the seal channel 314 of the push rod 216 is depicted having a substantially rectangular cross-section, such a configuration is not required. For example, the seal channel 314 of the push rod 216 can be configured with a rounded cross-section. In other examples, the seal channel 314 of the push rod 216 can be triangular. In still further embodiments, the seal channel 314 may not be required. For example, the push rod 216 can be formed with the seal 218 as a single integral part. For example, the seal 218 can be over-molded onto the push rod 216. In other examples, the push rod 216 can be formed from a sealing material with a protrusion extending from the body portion 312*c* to the sidewalls of the through-hole of the button retainer 204.

In many cases, the push rod recess 306 may be wider than the top surface 312*a* of the push rod 216. Thus, the button cap 202 may freely pivot about the top surface 312*a* of the push rod 216 without transferring torques associated with said pivoting.

Figure 3B:
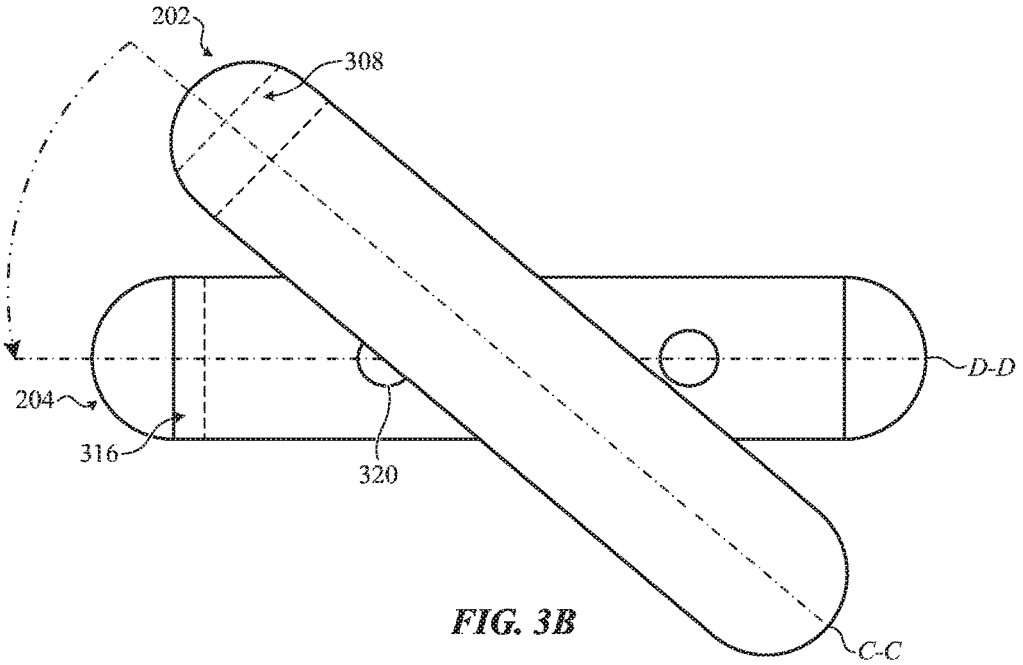
FIG. 3B depicts a top plan view of the sealed button assembly of FIG. 2B, showing the button cap rotating to interlock with the button retainer.

The button retainer 204 can also have multiple features. The button retainer 204 can include one or more wings 316 that are configured to interlock within the undercuts 308 of the button cap 202. In one embodiment, one or more wings 316 can interlock with the undercuts 308 by rotating the button cap 202. For example as shown in FIG. 3B, a longitudinal axis C-C of the button cap 202 can be rotated so as to be substantially parallel to a longitudinal axis D-D of the button retainer 204. In some embodiments, the one or more wings 316 can be axially symmetric. In other cases, such as is depicted in FIG. 3B, the one or more wings 316 can take an axially asymmetric shape. In some cases, the one or more wings 316 can extend across the width of the button retainer 204. In other cases, the one or more wings 316 can extend for a portion of the width of the button retainer 204, stopping the button cap 202 from further rotation once the longitudinal axis C-C is parallel to the longitudinal axis D-D.

Returning to FIG. 3A, the button retainer 204 can also include a base portion 318 which is configured to abut a floor of the counterbore defined by the housing 102. One or more screw cavities 320 are adjacent to the base portion 318 and oriented to face an internal volume of the housing 102. The one or more screw cavities 320 can be threaded or tap-able, and can receive the screws 208. The button retainer 204 can also define the through-hole 322 which is sized to receive the push rod 216. In addition, the button retainer 204 can also include one or more bias indentations 324 configured to receive and/or guide the placement of the compressible biasing member 220 between the button cap 202 and the button retainer 204.

In some embodiments, the bias indentations 324 can be formed as bias apertures that extend from the upper surface of the button retainer 204 to the lower surface of the button retainer 204. In these embodiments, the compressible biasing member 220 can be inserted through the bias indentations 324 during assembly. Thereafter, the bias indentations 324 can be closed and/or substantially sealed in order to retain the compressible biasing member 220 biased between the button retainer 204 and the button cap 202.

In many embodiments, the button retainer 204 can be formed from a rigid material such as metal or plastic. In some examples, the button retainer 204 can be formed from a combination of materials. Further, although the button retainer 204 is illustrated in cross-section as two separated components, it may be appreciated that in many embodiments the button retainer 204 is formed as a single unitary element.

The compressible dome 214 can also have multiple features. For example, the compressible dome 214 can include an apex portion 326. The width of the apex portion 326 of the compressible dome 214 can be selected based on the geometry of the bottom surface 312*b* of the push rod 216. The compressible dome 214 can be attached to the substrate 212. The substrate 212 can include one or more dome vents 328 which serve to vent the compressible dome 214 during a depression of the apex portion 326. The compressible dome 214 can be adhered to the substrate 212 with an adhesive. In another embodiment, the compressible dome 214 can be formed onto the substrate 212 in a manufacturing process.

The housing 102 can define a counterbore 330 that substantially takes the same shape as the button cap 202. Because the counterbore 330 does not extend entirely through the housing 102, a ledge 102*a* may be present. The ledge 102*a* may extend a certain distance from the sidewalls of the counterbore 330. Different embodiments may implement the ledge 102*a* differently. The ledge 102*a* can receive the base portion 318 of the button retainer 204. Additionally, and in many embodiments, the gasket seal 210 can be positioned between the base portion 318 of the button retainer 204 and the ledge 102*a*.

Although the ledge 102*a* is illustrated as substantially terminating at an internal sidewall of the housing 102, such a configuration is not required. For example, the ledge 102*a* may be present within a middle portion of the housing 102.

The rigid shim 222 can also have multiple features. For example, the rigid shim 222 can be disposed between the bracket 206 and an internal portion of the housing 102 corresponding to a surface of the ledge 102*a*. The rigid shim 222 can bias the bracket 206 into the volume of the housing 102. In this manner, the rigid shim 222 can provide an increased pull force on the button 106, drawing the button 106 into the housing 102.

The bracket 206 can also have multiple features. For example, alignment indentations 332 can be defined in a top surface of the bracket 206. The alignment indentations 332 can be used to align the bracket 206 to the electronic switch. In other embodiments, the alignment indentations 332 can be implemented as through-holes, visual fiducials, or pin apertures configured to receive or interface with a pin protruding from another element of the stack. Generally and broadly, the alignment indentations 332 can be implemented in any suitable manner to assist with alignment of the bracket 206 of the electronic switch; in certain embodiments, the alignment indentations 332 may take another form or may be omitted.

In addition, the bracket 206 can include one or more fastener apertures 334 which are sized and positioned to receive the screws 208 during assembly of the button 106. Further, although the bracket 206 is illustrated in cross-section as three separated components, it may be appreciated that in many embodiments the bracket 206 is formed as a single unitary element.

As noted above, the button assembly mechanically couples the button cap to the electrical switch via the separated push rod. In operation, the push rod axially translates within the through-hole of the button retainer in order to transfer force received at the button cap to the electronic switch. The electronic switch may be braced and/or supported by the retainer such that the downward force provided by the push rod may be focused onto the electronic switch which, in turn, activates the electronic switch.

Figure 4A:
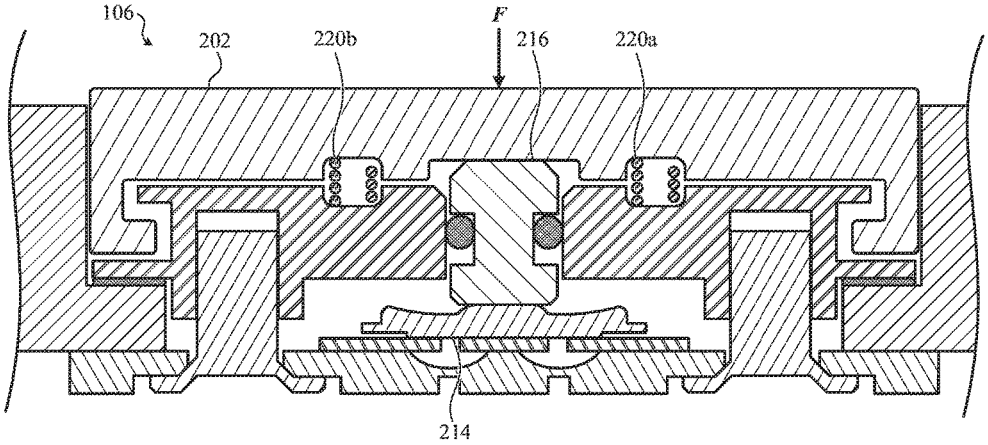
FIG. 4A depicts a cross-section view of the sealed button assembly of FIG. 1B taken through section B-B of FIG. 1B, depicting the sealed button assembly symmetrically compressing in response to receiving a downward force.
Figure 4B:
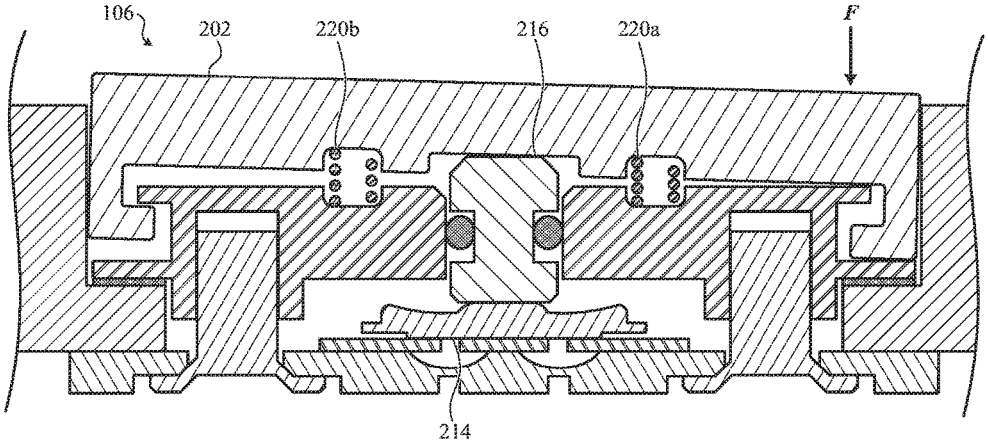
FIG. 4B depicts a cross-section view of the sealed button assembly of FIG. 1B taken through section B-B of FIG. 1B, depicting the sealed button assembly asymmetrically compressing in response to receiving a downward force.
Figure 4C:
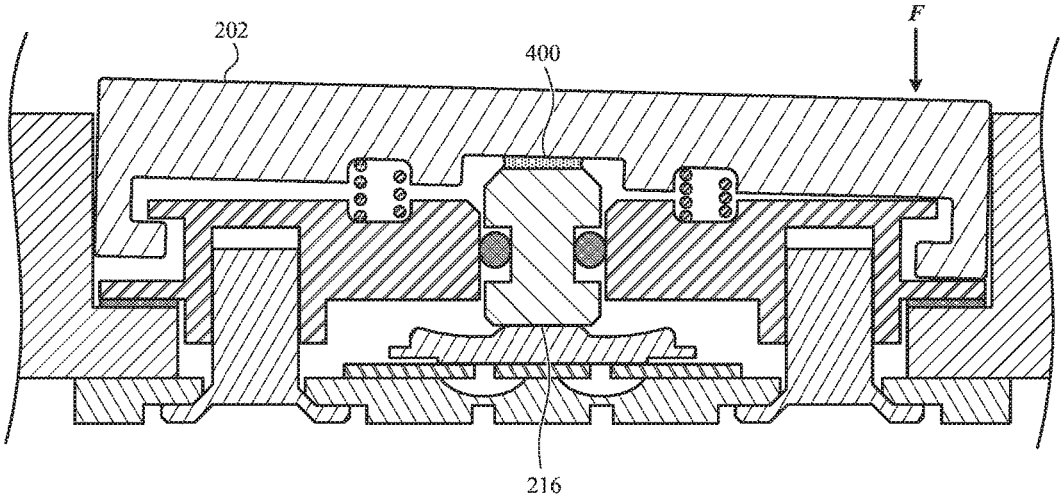
FIG. 4C depicts a cross-section view of another example sealed button assembly asymmetrically compressing in response to receiving a downward force.

In one example, such as depicted in FIG. 4A, a user press on the button cap 202 in a generally central location (e.g., on-axis press) can provide a substantially uniform and planar downward force F that is translated through the push rod 216 directly to the compressible dome 214, deforming the compressible dome 214. The planar downward force F can also compress the compressible biasing members 220*a*, 220*b* in a substantially uniform manner. In another example, such as is depicted in FIG. 4B, a user press of the button cap 202 in a generally non-central location (e.g., off-axis press, edge press, and so on) can provide a substantially non-uniform downward force F that may cause the button cap 202 to pivot, depressing the compressible biasing member 220*b* to a greater extent than the compressible biasing member 220*a*. However, as a result of the separation between the push rod 216 and the button cap 202, the push rod 216 can nevertheless apply a substantially planar downward force directly to the compressible dome 214, thereby causing the compressible dome 214 to deform. In this manner, the button cap 202 does not confer substantially any torque to the push rod 216.

In further embodiments, the button cap 202 can be flexibly coupled to the push rod 216, such as depicted in FIG.

4C. In such an embodiment, the flexible coupling 400 (e.g., silicone, flexible adhesive, and so on) can connect the push rod 216 to the button cap 202 in a manner that permits the push rod 216 to apply a planar downward force to the electrical switch. In this manner, the button cap 202 does not confer substantially any torque to the push rod 216.

Figure 5:
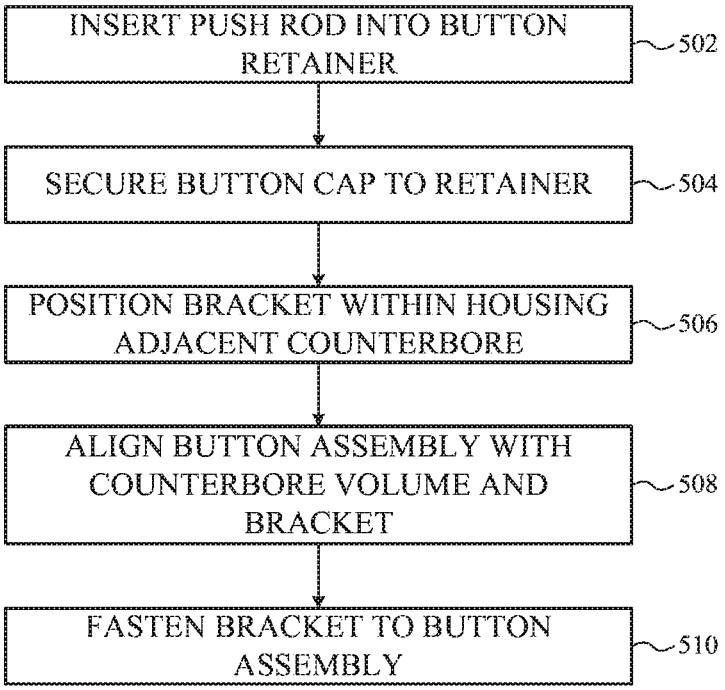
FIG. 5 depicts example operations of a method of coupling a sealed button assembly to a housing of an electronic device.

FIG. 5 depicts example operations of a method of coupling a sealed button assembly to a housing of an electronic device. The method can begin at operation 502 during which a push rod can be inserted through a button retainer. Next at operation 504, a button cap can be secured to the retainer, for example by twist-locking, or sliding. Next at operation 506, a bracket can be positioned within the housing of an electronic device, adjacent to a counterbore defined within the housing. Next, at operation 508 a button assembly including the button cap, button retainer, and the push rod can be aligned with the counterbore. Next, at operation 510, the bracket can be fastened to the button assembly through the counterbore, thereby affixing the button assembly to the housing.

As noted above, embodiments described herein relate to systems and methods for reliably and durably sealing buttons within portable electronic devices from liquid intrusion, although the various systems and methods described herein are not limited to particular form factors. Further, it should be appreciated that the various embodiments described herein, as well as the functionality, operation, components, and capabilities thereof may be combined with other elements or embodiments as necessary, and so any physical, functional, or operational discussion of any element, feature, structure, or interrelation therebetween is not intended to be limited solely to a particular embodiment to the exclusion of others.

For example, although FIG. 1A illustrates a wearable electronic device, other embodiments can take other forms. For example, an electronic device incorporating a sealed button assembly can be implemented in another manner or can take other forms such as, but not limited to, a laptop computer, a desktop computer, a peripheral input device, an accessory device, a tablet computer, a home appliance, a sports or activity tracker, a physiology tracker, an industrial device, a health tracking device, a fitness tracking device, a medical device, a power tool, a portable media player, a remote control device, and so on.

Additionally, electronic devices such as the wearable electronic device 100 depicted in FIG. 1A can be configured in a variety of forms to perform, monitor, or coordinate a variety of tasks. For example, the wearable electronic device 100 can be configured in the form of a wearable communications device. A wearable communications device may include a processor coupled with or in communication with a memory, one or more sensors, one or more communication interfaces, output devices such as displays and speakers, one or more input devices (e.g., force input and/or touch input), and a health monitoring system. The communication interfaces can provide electronic communications between the communications device and any external communication network, device or platform, such as but not limited to wireless interfaces, Bluetooth interfaces, universal serial bus interfaces, Wi-Fi interfaces, TCP/IP interfaces, network communications interfaces, or any conventional or proprietary communication interfaces. The wearable communications device may provide information regarding time, health, statuses of externally connected or communicating devices and/or software executing on such devices, messages, video, operating commands, and so forth (and may receive any of the foregoing from an external device), in addition to communications. As should be appreciated, for simplicity of illustration, the wearable electronic device 100 is depicted in FIG. 1A without many of these elements, each of which may be included, partially, optionally, or entirely, within a housing 102.

In some embodiments, the housing 102 can form an outer surface or partial outer surface and protective case for the internal components of the wearable electronic device 100. In the illustrated embodiment, the housing 102 is formed into a substantially rectangular shape, although this configuration is not required.

In some embodiments, the housing 102 can be formed of one or more components operably connected together, such as a front piece and a back piece or a complementary clamshell portions. Alternatively, the housing 102 can be formed of a single piece (e.g., uniform body or unibody). The housing 102 can be coupled to a coupling mechanism used to attach to a user. For example, as illustrated, the housing 102 can be coupled to a band suitable for attaching to a user's wrist.

Also, in some embodiments, the housing 102 can, at least partially, surround a display 104. In many examples, the display 104 may incorporate an input device configured to receive touch input, force input, and the like and/or may output information to a user, such as various health parameters or physiological data. The display 104 can be implemented with any suitable technology, including, but not limited to, a multi-touch or multi-force sensing touchscreen that uses liquid crystal display (LCD) technology, light emitting diode (LED) technology, organic light-emitting display (OLED) technology, organic electroluminescence (OEL) technology, or another type of display technology.

As noted above, the wearable electronic device 100 can include the button 106 in accordance with embodiments described herein. In other cases, a wearable electronic device can incorporate one or more buttons that are implemented substantially as described above.

Additionally, for some embodiments described herein, a button such as the button 106 may be formed as a rectangle with rounded opposing sides (e.g., capsule-shaped), such as depicted in FIG. 1B. In these and other embodiments, the button 106 can be finished with a manufacturing process selected to provide a desirable cosmetic finish to an external surface of the button 106. For example, the button 106 can be finished with a chamfered perimeter edge. In some embodiments, the button 106 can be polished to a mirror finish, or can be formed or finished with a matte finish. In some examples, a symbol, glyph, or other informational graphic (not shown) can be disposed onto the external surface of the button 106. For example, in some embodiments a laser ablation process can be used to etch an information graphic related to the functionality of the button 106 into the external surface of the button 106. In other examples, an informational graphic can be formed by depositing ink onto the external surface of the button 106.

The button 106 may be formed from the same material as that of the housing 102. For example, the housing 102 and the button 106 can be formed from metal (e.g., stainless steel, aluminum, gold, platinum, and so on). In other cases, the housing 102 and the button 106 can be formed from a polymer (e.g., elastomer, plastic, nylon, and so on). In still further examples, the housing 102 and the button 106 can be formed from a ceramic material (e.g., zirconia, alumina, and so on). In still further examples, the housing 102 and the button 106 can be formed from glass or sapphire. In these and other embodiments, the housing 102 and the button 106 can be finished in substantially the same manner so as to provide the wearable electronic device 100 with a substantially consistent cosmetic appearance.

In some embodiments, the housing 102 and the button 106 can be formed from different materials. For example, the housing 102 can be formed from metal and the button 106 can be formed from sapphire.

In still further examples, either or both the housing 102 and the button 106 can be formed from a combination of materials. For example, the housing 102 can be formed from both metallic portions and non-metallic portions. In such an example, one or more metallic portions of the housing 102 can be coupled to one or more electrical circuits configured to perform, monitor, or coordinate one or more electrical operations of the wearable electronic device 100. For example, the metallic portions can be associated with a sensor included within the wearable electronic device 100. In other examples, the metallic portions can be associated with a wireless communication circuit (e.g., Bluetooth, Wi-Fi, cellular communications, and so on) of the wearable electronic device 100.

In some examples, either or both the housing 102 and the button 106 can be formed, at least in part, from a material that is transparent to certain frequency bands of light (e.g., infrared, ultraviolet, visible light, and so on). For example, in some cases the button 106 can be transparent to infrared light while remaining substantially opaque to other frequency bands of light. In these examples, a light emitting component may be optically coupled to the button 106 in order to provide information to a user 108 (e.g., status light, and so on).

Also the wearable electronic device 100 can use the button 106 to facilitate user interaction. In one example, a press of the button 106 can cause a user interface element rendered by the display 104 to change. In other examples, the button 106 can be associated with a different functionality (or multiple functionalities depending on a state of the wearable electronic device 100) of the wearable electronic device 100. In one example in which the button 106 is a power button, the wearable electronic device 100 can respond to a press of the button 106 by the user 108 by entering a power-saving mode (e.g., low-power mode). In another example, the button 106 can be implemented as a home button. In such an example, the wearable electronic device 100 can cause the display 104 to draw a graphical representation of an array of applications available for selection by the user 108. In yet another example, the button 106 can be implemented to perform another function of the wearable electronic device 100 such as, but not limited to, starting or ending a telephone call, launching a dictation application, launching a communication application (e.g., text, email, phone, pictographic communication, and so on), launching an application displaying a list or dial of preferred contacts of the user 108, launching a mapping application, placing the wearable electronic device 100 into a sleep mode, starting or stopping a timer, increasing or decreasing the tightness of a band 110 which couples the wearable electronic device 100 to the user 108, increasing or decreasing audio volume output from one or more speakers, controlling or accessing information from a separate electronic device, launching a health-monitoring application, activating one or more sensors of the wearable electronic device 100, activating a physiological sensor of the wearable electronic device 100, and so on. One may appreciate that the functionality of the button 106, and, more generally, the function or functions for which the wearable electronic device 100 incorporates the button 106, can vary from embodiment to embodiment and, as such, the listing of example functions or features herein is not intended to be exhaustive.

One may appreciate that although many embodiments are disclosed above, that the operations and steps presented with respect to methods and techniques described herein are meant as exemplary and accordingly are not exhaustive. One may further appreciate that alternate step order or, fewer or additional steps may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the some embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A button assembly comprising:
a button cap defining a flange;
a push rod positioned below the button cap;
a retainer comprising a body defining: an aperture adapted to receive the push rod; and
an electrical switch adjacent the push rod; a first cavity at a first side of the retainer and configured to receive a first fastener; and a second cavity at a second side of the retainer and configured to receive a second fastener
wherein the flange is configured to:
engage the body to retain the button cap to the body; and
move relative to the body in response to an actuation force applied to the button cap.

2. The button assembly of claim 1, further comprising a biasing member between the button cap and the body and configured to bias the button cap towards an unactuated position.

3. The button assembly of claim 1, further comprising a compressible biasing member configured to bias the button cap away from the retainer.

4. The button assembly of claim 1, wherein:
the button cap defines:
an exterior surface; and
an interior surface opposite the exterior surface and defining a recess; and
the push rod is positioned at least partially within the recess.

5. The button assembly of claim 1,
wherein the retainer comprises a wing extending from the body.

6. The button assembly of claim 1, wherein the push rod interfaces with the electrical switch.

7. The button assembly of claim 1, further comprising a gasket seal positioned between an electronic device housing and the retainer.

8. The button assembly of claim 1, wherein the push rod comprises:
a body portion; and
a seal channel within the body portion.

9. The button assembly of claim 8, further comprising a push rod seal positioned within the seal channel.

10. The button assembly of claim 1, further comprising:
a bracket positioned within a housing of an electronic device and fastened to the retainer, thereby clamping the button assembly to at least a portion of the housing.

11. The button assembly of claim 10, wherein the electrical switch is fixedly coupled to the bracket.

12. The button assembly of claim 10, wherein the bracket is fixedly coupled to the retainer.

13. The button assembly of claim 10, further comprising a shim positioned between the bracket and the housing.

14. The button assembly of claim 13, wherein the shim comprises:
a first layer formed from metal; and
a second layer formed from an adhesive.

15. The button assembly of claim 13, wherein the shim comprises:
a first layer formed from metal; and
a second layer formed from a compressible foam.

16. A method for assembling a sealed button comprising:
positioning a seal at least partially within a seal channel of a push rod;
positioning the push rod within a through-hole extending through a retainer, the retainer comprising: a first fastener opening on a first side of the through-hole; and a second fastener opening on a second side of the through-hole
positioning a cap over the retainer such that the push rod is at least partially received within a recess defined in a base of the cap;
interlocking a wing of the retainer with a flange defined in the cap to retain the cap to the retainer while allowing the flange to translate relative to the retainer in response to an actuation force applied to the cap;
positioning the cap, push rod, and retainer adjacent to a counterbore defined in a housing of an electronic device;
positioning a bracket adjacent to the counterbore; and
fastening the bracket to the retainer through the counterbore.

17. The method of claim 16, further comprising forming the cap to take a shape of a rounded rectangle.

18. The method of claim 16, further comprising positioning an electrical switch on the bracket adjacent to a bottom surface of the push rod.

19. The method of claim 16, further comprising positioning a biasing member between the retainer and the cap.

20. An electronic device comprising:
an enclosure defining:
a button opening; and
a shelf extending into the button opening; and
a button comprising:
a cap positioned above the shelf and defining a flange;
a cap retainer positioned between the cap and the shelf and defining a wing that at least partially overlaps the flange so as to retain the cap to the retainer while allowing the flange to move relative to the enclosure when the cap is pressed; a first cavity at a first end of the cap retainer; and a second cavity at a second end of the cap retainer; and
a push rod adjacent a bottom surface of the cap and extending through the cap retainer such that motion of the cap moves the push rod but not the cap retainer.

21. The electronic device of claim 20, further comprising a bracket positioned below the shelf.

22. The electronic device of claim 20, further comprising an electrical switch portion positioned between the bracket and the cap retainer and below the push rod.

23. The electronic device of claim 21, wherein the bracket is rigidly fastened to the cap retainer via a first fastener received in the first cavity and a second fastener received in the second cavity.

24. The electronic device of claim 20, further comprising a gasket seal between the cap retainer and the shelf.

25. The electronic device of claim 20, further comprising a spring positioned between the cap and the cap retainer and configured to bias the flange into engagement with the wing.

26. The electronic device of claim 20, wherein the push rod comprises a cylinder comprising a seal channel.

27. The electronic device of claim 26, further comprising an O-ring seal positioned over the push rod at least partially within the seal channel.

* * * * *